United States Patent [19]

Gibb et al.

[11] Patent Number: 4,856,430

[45] Date of Patent: Aug. 15, 1989

[54] WALL-BREACHING APPARATUS

[75] Inventors: Allan W. M. Gibb, Medicine Hat; Hans R. Gartner, Limoges; A. William Bauer, Kingston; Dennis P. Chadwick, Napanee, all of Canada

[73] Assignee: Her Majesty the Queen in right of Canada, as represented by the Minister of National Defence, Canada

[21] Appl. No.: 195,833

[22] Filed: May 19, 1988

[51] Int. Cl.[4] ..... F42B 1/02

[52] U.S. Cl. ..... 102/307; 89/1.14

[58] Field of Search ..... 102/306, 307, 309, 310, 102/311, 331, 301, 701, 293; 83/1.816, 1.14

[56] References Cited

U.S. PATENT DOCUMENTS

| | | | |
|---|---|---|---|
| 3,169,479 | 2/1965 | Bryan | 102/307 |
| 3,374,737 | 3/1968 | Pike | 102/307 |
| 3,477,372 | 11/1969 | McFerrin et al. | 102/307 |
| 3,712,221 | 1/1973 | Voigt et al. | 102/307 |
| 3,960,085 | 6/1976 | Abernathy et al. | 102/701 |
| 4,418,622 | 12/1983 | Foster et al. | 102/307 |
| 4,430,939 | 2/1984 | Harrold | 102/307 |
| 4,485,718 | 12/1984 | Furmawski et al. | 89/1.14 |
| 4,499,828 | 2/1985 | Honodel | 102/301 |

*Primary Examiner*—David H. Brown

*Attorney, Agent, or Firm*—Roylance, Abrams, Berdo & Goodman

[57] ABSTRACT

A novel wall breaching apparatus may be constructed with sufficiently small weight and dimensions that it is effectively portable, while being sufficiently energetic to breach a thick wall. The apparatus consists of a number of similar panels, each including a matrix and a linear shaped charge embedded in the matrix. Each end of the charge is located adjacent an edge of the panel. The panels are configured to be assembled edge to edge in an open condition with the linear shaped charges arranged end to end, or face to face in a closed condition, with the linear shaped charges on the inside of the assembly. Thus, the apparatus may be collapsed to the closed position for storage and transport and assembled in its open condition to produce a single "semi-continuous" linear charge of fixed shape. The arrangement of the shaped charges end to end produces the "semi-continuous" linear shaped charge arrangement without the dimensional penalties associated with a continuous charge of the same size and configuration. The apparatus may be made considerably lighter than the known linear shaped charge device by using no metal confinement on the charge. The explosive weight per unit length may be increased to compensate for the lack of confinement without offsetting the considerable weight gains to be achieved. The ommission of the confinement also dramatically reduces the fragmentation hazard on the charge side of the wall.

24 Claims, 5 Drawing Sheets

WALL-BREACHING APPARATUS

FIELD OF THE INVENTION

The present invention relates to a wall breaching apparatus and more particularly to an explosive apparatus for producing a hole in a wall.

BACKGROUND

The existing methods of breaching a wall explosively employ one or more pressure charges or a continuous ring or rectangle of linear shaped charges. Both methods have their disadvantages.

The use of an explosive pressure charge is a brute force approach that requires a relatively large quantity of explosive to breach a hole large enough for a man to crawl through. The quantity of explosive required for a wall of moderate thickness is sufficient to shatter nearby windows, create a blast hazard for nearby personnel and cause some structural damage on weaker structures.

For a continuous linear shaped charge device of sufficient explosive strength and surface area to produce an adequate breach in heavy walls, the dimensions, and usually the weight are excessive for effective portability.

SUMMARY OF THE INVENTION

The present invention is concerned with the provision of a novel apparatus that may be constructed with sufficiently small weight and dimensions that it is effectively portable, while being sufficiently energetic to breach a thick wall.

According to the present invention there is provided a wall-breaching apparatus comprising a plurality of panels, each including a matrix and a linear shaped charge embedded in the matrix with each of its ends adjacent an edge of the panel, the panels being configured to be assembled in an open condition with the panels arranged edge to edge and the linear shaped charges arranged end to end, and the panels being configured to be assembled in a closed condition with the panels arranged face to face, with the linear shaped charges adjacent the internal faces.

With this arrangement, the apparatus may be collapsed to the closed position for storage and transport and assembled in its open condition to produce a single "semi-continuous" linear charge of fixed shape. The arrangement of the shaped charges end to end produces the "semi-continuous" linear shaped charge arrangement without the dimensional penalties associated with a continuous charge of the same size and configuration.

Where desired, embodiments of the apparatus may be made considerably lighter than the known linear shaped charge devices by using no metal confinement on the charge. The explosive weight per unit length may be increased to compensate for the lack of confinement without offsetting the considerable weight gains to be achieved. The omission of the confinement also dramatically reduces the fragmentation hazard on the charge side of the wall.

In preferred embodiments of the invention the panels of the apparatus are hinged to one another so that it can readily be unfolded to the open condition.

A hard shell may be provided on the matrix. The shell and matrix then serve as a protective container for the charges in the closed condition and as a support matrix for the charge in the open condition.

BRIEF DESCRIPTION OF THE DRAWINGS

In the accompanying drawings which illustrate exemplary embodiments of the present invention.

DETAILED DESCRIPTION

Figure 1:
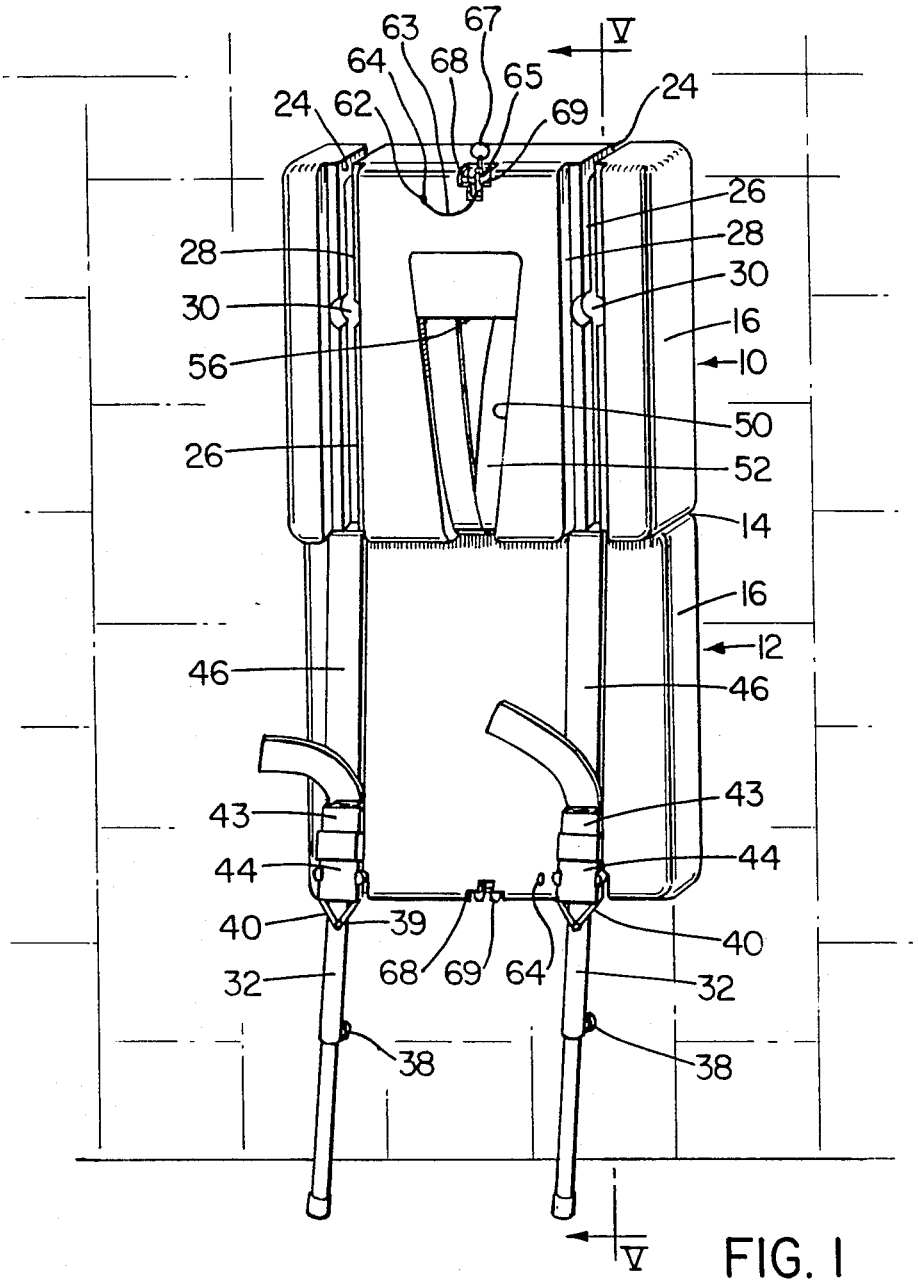
FIG. 1 is an isometric view of a two panel embodiment of the invention in open condition, against a wall.

Referring to the drawings, FIGS. 1 through 7 illustrate a two panel embodiment of the wall breaching apparatus. In this embodiment, two rectangular panels 10 and 12 are pivotally connected by a hinge 14 extending along adjacent panel edges, at the inside face of the panels. This allows the panels to pivot between the closed position of FIGS. 3 and 6 where the two panels are arranged face to face and the open condition of FIGS. 1, 2 and 5 where the panels are arranged edge to edge. The panels can be used separately by pulling the hinge pin (not shown) from the hinge 14, to separate them.

Figure 2:
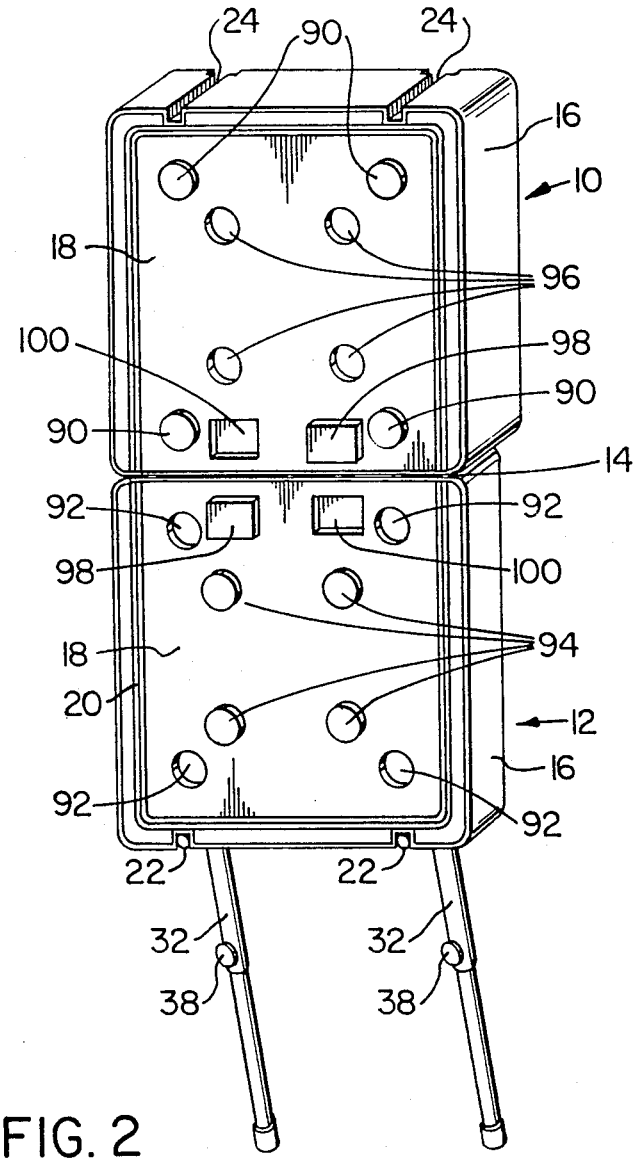
FIG. 2 is an isometric of the view like FIG. 1, from the opposite side.

The exterior of each panel 10 and 12 is covered with a protective shell 16 of hard material such as a fiber glass-resin composite. In the closed condition, this covers the complete exterior of the apparatus with a shell of protective material. Inside the shell, each panel consists of a matrix 18 of shock absorbing material, in this embodiment a block of closed cell synthetic foam. Embedded in the matrix of each panel is a V-shaped linear shaped charge 20 that follows the periphery of the panel and has its ends located adjacent the hinge line 14. In the open condition of the device the two linear shaped charge segments are arranged end to end in a closed loop, as shown in FIG. 2.

The back panel 12 has a pair of parallel grooves 22 in one edge extending between the inner and outer faces of the panel. In the closed position of the apparatus (FIGS. 3 and 6), the grooves 22 align with similiar grooves 24 in the panel 10. These in turn continue down the outer face of panel 10 as grooves 26 recessed into the bases of wider, shallower parallel channels 28 in the outer face of the panel 10. The channels 28 and grooves 26 extend fully across the panel. A circular well 30 is formed in the base of each channel 28. The function of these wells will be described more fully in the following.

Figure 5:
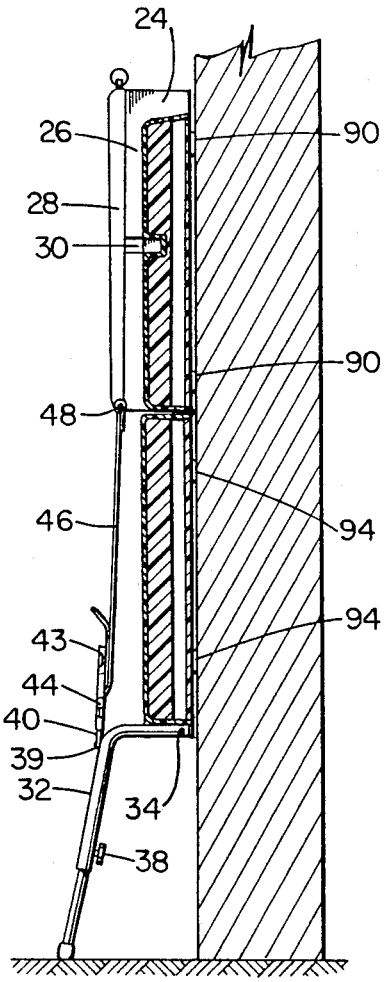
FIG. 5 is a sectional view along line V—V of FIG. 1.
Figure 6:
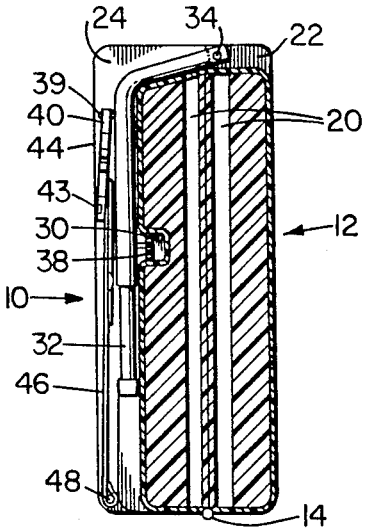
FIG. 6 is a sectional view along line VI—VI of FIG. 3.
Figure 7:
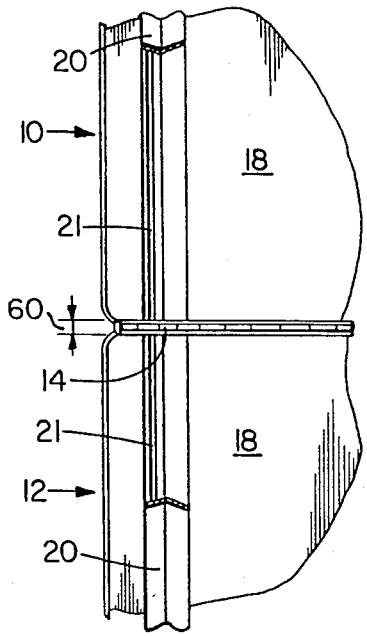
FIG. 7 is an enlarged view of a detail showing two linear shaped charge segments in end to end relation.

Two L-shaped supports 32 have the ends of their short arms pivotally connected to the panel 12 in the respective grooves 22 by pins 34 (FIG. 5) that extend across the grooves. In the open position of the apparatus, as illustrated in FIGS. 1, 2 and 5, the short arms of the supports 32 extend along the grooves 22 to the back face of panel 12. The longer arms project away from the panel, at an oblique angle to its outer face and serve to support the open assembly on a ground surface. The longer leg of each support is telescopically adjustable to accommodate rough terrain. A locking screw 38 fixes the leg in an adjusted position.

A loop 39 on each support, adjacent the angle is pivotally connected to a strap 40. The strap 40 is in turn permanently affixed to one component of a quick-release buckle 44. The other component of the buckle 44 is adjustably attached to a strap 46 that is secured to an anchoring pin 48 extending across a respective one of the channels 28 in the outer face of panel 10. The arrangement is illustrated particularly in FIGS. 1 and 5 where the strap 46 is shown as tightened to retain the supports 32 and panel 10 in an open condition through engagement of the support with the channel 22 and the engagement of the adjacent edges of the panels 10 and 12.

In the closed condition of the apparatus, the supports 32 extend from the panel 12, along the grooves 24 and 26 of panel 10. The straps 46 connect the pins 48 and buckles 44 to retain the supports 32 in place and thus to keep the apparatus in its closed condition as most particularly illustrated in FIGS. 3 and 6. The heads of adjustment screws 38 are accommodated in the wells 30.

As shown in FIG. 2, each of the linear charges 20 is formed into a V-shape that generally follows the periphery of the associated panel. The charge is embedded in the matrix 18 of the panel and has its ends located at the periphery of the panel. In the open condition of the apparatus, the ends of the two charges are in alignment. The gap 60 (FIG. 7) between the ends of the charges is sufficiently small that it is bridged on detonation of the charge, so that the charge acts as a closed continuous linear charge, despite the discontinuities.

In this embodiment, the changes are provided with metal liners 21 (FIG. 7) and are unconfined.

Figure 4:
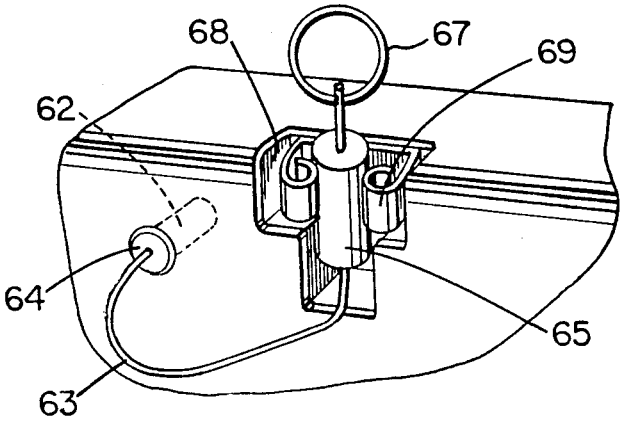
FIG. 4 is an enlarged view of the detonator wall area.

Referring to FIGS. 1 and 4, the charge is ignited by locating a detonator 62 in a detonator well 64 in the outer face of one of the panels. One well extends into each panel 10 and 12. They extend in depth to the back side of the linear charge.

The detonator 62 is ignited by a safety fuse 63 which is in turn ignited by an igniter 65, actuated by pulling on a ring 67. The igniter is held in a recess 68 in the panel by a spring clip 69.

An alternative to the manual igniter arrangement illustrated is an electric detonator that fits into the same detonator well.

Figure 3:
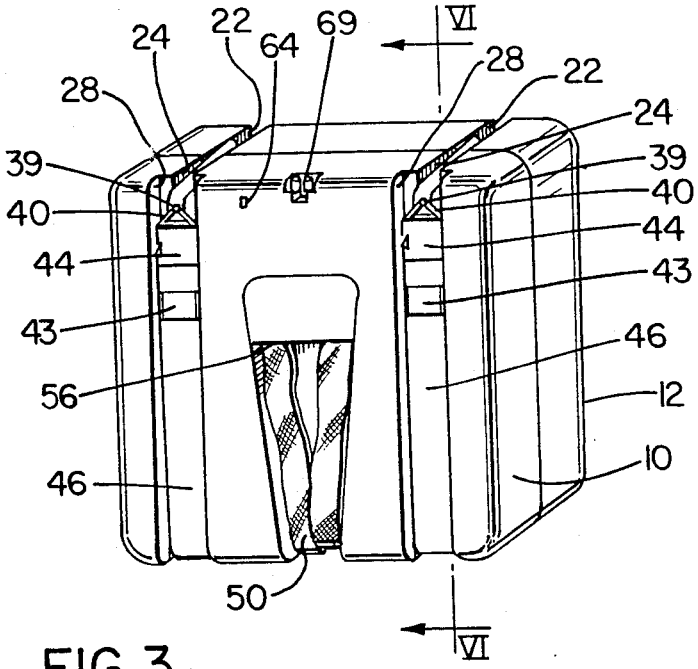
FIG. 3 is an isometric view of the apparatus of FIG. 1 in the closed condition.

As illustrated in FIGS. 1 and 3, there is a recess 50 formed in the outer face of panel 10. This accommodates a shoulder harness 52 for carrying the apparatus in the manner of a backpack. The harness includes two straps and two adjustable quick-release buckle paths (not shown) that connect to two buckle parts 43 associated with the buckles 44. The end of the recess at 56 is undercut to provide a carrying handle.

As illustrated most particularly in FIGS. 2 and 5, the inner face of panel 10 has four projections 90 that serve to engage a surface to be breached to place the linear charge 20 at the correct stand off distance. These projections are accomodated in mating recesses 92 in the inner face of panel 12 when the device is in the closed condition. Similiar projections 92 are provided on the inner face of panel 12, with mating recesses 96 formed on the inner face of panel 10.

Each of panels 10 and 12 is equipped with a "kicker" charge 98 that is ignited after detonation of the linear shaped charge 20 to provide sufficient pressure to assist in "knocking out" the wall section cut out by the linear shaped charge. In the closed condition of the device, each kicker charge is accomodated in a recess 100 in the mating face of the opposing panel. This kicker charge may be omitted in some embodiments.

FIGS. 8A to 8E illustrate a four-panel embodiment of the invention consisting of a first back panel 70, second and third intermediate panels 72 and 74 respectively and a fourth front panel 76. These panels are arranged in face-to-face relation in the closed condition as shown in FIG. 8 (A). The panel 70 has a hard shell on its back face and peripheral edge, while the front panel 76 has a hard shell on its front face and peripheral edge and the intermediate panels 72 and 74 have hard shells on their confronting faces (in the closed condition) and their peripheral edges.

Figure 8A:
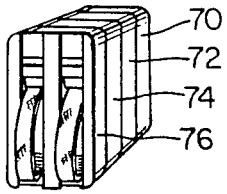
FIGS. 8A through 8E are diagrammatic views of a four panel embodiment of the invention showing the opening sequence.
Figure 8B:
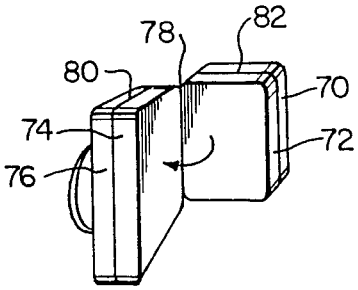
Figure 8C:
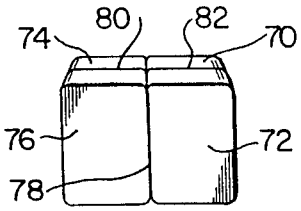
Figure 8D:
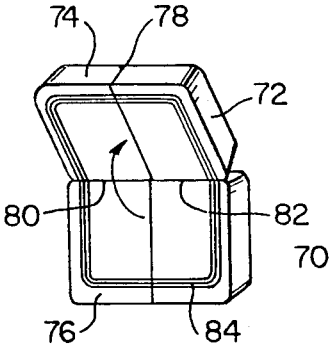
Figure 8E:
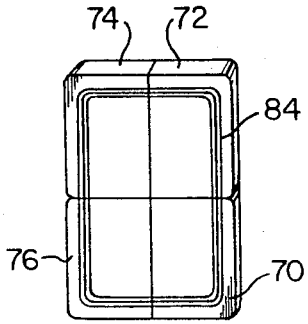

To open the apparatus, the panels 74 and 76 are pivotted as a unit about a hinge 78 joining the inner faces of panels 72 and 74. This yields the half-open orientation of FIG. 8(C), in which panels 72 and 74 are in edge-to-edge abutment and arranged face-to-face with panels 82 and 80, which are also oriented edge-to-edge. The panels 72 and 74 are then pivoted as a unit about a hinge 80 joining the abutting faces of panels 74 and 76 and a hinge 82 joining the abutting faces of panels 72 and 70, generally as shown in FIG. 8(D). This brings the panels to the open condition shown in FIG. 8(E) with the panels arranged in edge-to-edge relation. The linear charges of these panels are all L-shaped and follow the peripheries of the respective panels. In the open condition, the charges are arranged end-to-end in a semi-continuous loop.

While two embodiments of the invention have been described, it will be apparent to those skilled in the art that others are possible within the scope of the present invention. For example, various arrangements with differing numbers of panels may be constructed. The carrying and support arrangements illustrated and described are not essential and will vary from embodiment to embodiment, as will the method for locking the panels in the open position. The linear charges, while shown as forming a "semi-continuous" closed loop, may also be arranged in a "U"-shaped or other configuration. Booster charges may be provided at each end of both U-shaped loops to assist the detonation in crossing the air gap between charge halves.

While the embodiments of FIGS. 1 to 7 has been described as having unconfined linear charges with metal lining, it is possible to construct embodiments of the invention with metal confinement, without metal liners or with any conformation of liners and confinement that is effective for the purposes of the embodiment in question.

It is thus to be understood that the exemplary embodiments described in the foregoing are intended as exemplary only, and not limiting. The scope of the invention is to be ascertained solely by reference to the appended claims.

We claim:

1. A wall-breaching apparatus comprising a plurality of panels, each including a matrix and a linear shaped charge embedded in the matrix with each of its ends adjacent an edge of the panel, the panels being configured to be assembled in an open condition with the panels arranged edge to edge and the linear shaped charges arranged end to end, and the panels being configured to be assembled in a closed condition with the panels arranged face to face, with the linear shaped charges adjacent the internal faces.

2. A wall-breaching apparatus according to claim 1 including a shell of hard material covering the exterior of the apparatus in the closed condition.

3. A wall-breaching apparatus according to claim 1 wherein the shaped charges are unconfined.

4. A wall-breaching apparatus according to claim 1 wherein the shaped charges have solid liners.

5. A wall-breaching apparatus comprising:

a plurality of panels each with an outer face, an inner face and a peripheral edge, and each panel comprising a matrix and an unconfined linear shaped charge embedded in the matrix with its ends adjacent the peripheral edge of the panel;

a hard shell on at least the peripheral edge of each panel and a hard shell on the outer face of at least two of the panels;

first retaining means for retaining the panels in an open position, with the panels in edge to edge relation, the inner faces substantially coplanar and the linear shaped charges arranged end to end;

second retaining means for retaining the panels in a closed position, with the panels in face to face relation, each inner face confronting another panel and each exposed outer face being an outer face with a hard shell.

6. Apparatus according to claim 5, including hinge means pivotally connecting each panel to at least one other panel.

7. Apparatus according to claim 5, including a detonator well formed in an outer face of at least one panel to receive a detonator for detonating the linear shaped charge.

8. Apparatus according to claim 5, including carrying means mounted on the apparatus to provide manual portability.

9. Apparatus according to claim 8, wherein the carrying means comprise a handle formed in an outer face of one panel.

10. Apparatus according to claim 8, wherein the carrying means comprise a shoulder harness secured to one panel.

11. Apparatus according to claim 5, wherein the second retaining means includes legs adapted to support the panels against a wall when the panels are in an open condition.

12. An apparatus according to claim 11, wherein the legs are substantially L-shaped.

13. Apparatus according to claim 12, wherein one end of each leg is pivotally secured to one panel, and the other end is adapted to be releasably secured to another panel to hold the panels in their closed position.

14. A wall-breaching apparatus comprising:

two panels, each with an outer face, an inner face and a peripheral edge, each panel comprising a matrix, and a linear shaped charge embedded in the matrix with its ends adjacent the peripheral edge of the panel;

hinge means connecting the panels to pivot between a closed position with the inner faces confronting one another and an open position with the inner faces substantially coplanar and the linear shaped charges arranged end to end.

15. Apparatus according to claim 14 wherein the linear shaped charges form a closed loop in the open condition of the apparatus.

16. Apparatus according to claim 14 wherein the linear shaped charges form a closed loop in the open condition of the apparatus and a booster charge is placed at a central region of the closed loop.

17. Apparatus according to claim 14 wherein the matrix is a synthetic foam material.

18. Apparatus according to claim 14 wherein the matrix is a closed cell synthetic foam material.

19. Apparatus according to claim 14 including a detonator well formed in one of the panels adjacent the linear shaped charge.

20. Apparatus according to claim 14 including a detonator well formed in one of the panels adjacent the linear shaped charge, an igniter well formed in the panel adjacent the detonator well and a spring clip in the igniter well for retaining a non-electric igniter for a safety fuse.

21. Apparatus according to claim 14, including retaining means for retaining the panels in the closed position.

22. Apparatus according to claim 21, wherein the retaining means comprise two legs pivotally connected to one of the panels for movement between a locking position extending over the outer face of the other panel and a releasing position projecting from the one panel so as to allow the other panel to pivot about the hinge means to the open position.

23. Apparatus according to claim 22, including leg retaining means for retaining the legs in the releasing position for use as a support for the apparatus.

24. Apparatus according to claim 23, wherein the retaining means comprise straps each with a first end fastened to a resective one of the legs, a second end secured to the second panel and a buckle for securing the first end to the second end.

* * * * *